US006564605B1

(12) United States Patent
Gafri et al.

(10) Patent No.: US 6,564,605 B1
(45) Date of Patent: May 20, 2003

(54) APPARATUS AND METHOD FOR PULSED MAGNETIC FORMING OF A DISH FROM A PLANAR PLATE

(75) Inventors: Oren Gafri, Rishon-Le-Zion (IL); Yuri Livshiz, Rishon-Le-Zion (IL)

(73) Assignee: Pulsar Welding Ltd., Yavne (IL)

( * ) Notice: Subject to any disclaimer, the term of this patent is extended or adjusted under 35 U.S.C. 154(b) by 0 days.

(21) Appl. No.: 09/582,651

(22) PCT Filed: Dec. 29, 1998

(86) PCT No.: PCT/IL98/00629

§ 371 (c)(1),
(2), (4) Date: Aug. 29, 2000

(87) PCT Pub. No.: WO99/33591

PCT Pub. Date: Jul. 8, 1999

(30) Foreign Application Priority Data

Dec. 29, 1997 (IL) ..... 122794

(51) Int. Cl.[7] ..... B26D 26/14; F16J 3/00

(52) U.S. Cl. ..... 72/56; 72/707; 72/55; 29/419.2

(58) Field of Search ..... 72/54, 55, 56, 72/705, 706, 707; 29/419.2

(56) References Cited

U.S. PATENT DOCUMENTS

| | | | | |
|---|---|---|---|---|
| 3,115,857 A | | 12/1963 | Pfanner et al. | |
| 3,175,383 A | | 3/1965 | Levine | |
| 3,372,566 A | * | 3/1968 | Schenk et al. | 72/56 |
| 3,618,350 A | * | 11/1971 | Larrimer, Jr. et al. | 72/56 |
| 3,654,787 A | | 4/1972 | Brower | |
| 3,961,739 A | | 6/1976 | Leftheris | |
| 4,170,887 A | | 10/1979 | Baranov | |
| 4,531,393 A | | 7/1985 | Weir | |
| 4,619,127 A | * | 10/1986 | Sano et al. | 72/56 |
| 4,807,731 A | | 2/1989 | Collins | |
| 5,353,617 A | | 10/1994 | Cherian et al. | |
| 5,442,846 A | | 8/1995 | Snaper | |
| 5,860,306 A | * | 1/1999 | Daehn et al. | 72/707 |

FOREIGN PATENT DOCUMENTS

| | | |
|---|---|---|
| DE | 1 809 070 | 7/1970 |
| WO | 97 22426 | 6/1997 |
| WO | 98/26480 | 6/1998 |

* cited by examiner

*Primary Examiner*—David B. Jones
(74) *Attorney, Agent, or Firm*—Browdy and Neimark, P.L.L.C.

(57) ABSTRACT

An electromagnetic forming apparatus for forming an essentially planar metal plate into a dish having a three-dimensional pattern, is provided. The apparatus comprises a mould having a forming surface with a contour corresponding to said three-dimensional pattern; a forming coil device; and an electric discharge circuitry for discharging a short and intense electric current pulse through the forming coil device to yield a pulsed magnetic forming (PMF) force for deforming said plate.

4 Claims, 8 Drawing Sheets

APPARATUS AND METHOD FOR PULSED MAGNETIC FORMING OF A DISH FROM A PLANAR PLATE

CROSS REFERENCE TO RELATED APPLICATION

The present application is the national stage under 35 U.S.C. 371 of PCT/IL98/00629, filed Dec. 29, 1998.

FIELD OF THE INVENTION

The present invention is generally in the field of pulsed magnetic forming (PMF) and provides an apparatus and method for such forming. More particularly, the present invention relates to a PMF process forming of a dish from a planar plate.

BACKGROUND OF THE INVENTION

Metal objects can be formed to have a desired shape by a variety of processes. For example, metal in a liquid form, can be molded to have the desired final shape. However, such a process is applicable in certain specific cases and in addition requires the expense of a large amount of energy and complicated and costly installations for heating and cooling.

Metal has some pliability and accordingly metalwork pieces of one shape can at times be formed to have another shape. For example, a metal plate can be formed and cut to have a wide variety of desired shapes by using a mechanical press. Such pressing methods require a very costly and large installations required for achieving the necessary pressure for attaining the desired final object.

PMF is a process in which a metal workpiece or a portion thereof is put into a rapid motion by pulse magnetic fields which causes the workpiece to deform. One advantage of the PMF process is in that energy loss in this process is minimal and consequently there is no or very little heating of the workpiece. In addition, this process does not have the disadvantage of leaving tool marks, as is the case in a variety of other techniques. The PMF process uses a discharge capacitor or a bank of capacitors, a forming coil and often a field shaper, for creating an intense transient magnetic field. Very intense magnetic fields created in the PMF process, is a result of the rapid discharge of electric energy, stored in the capacitors, through the forming coil. The resulting eddy currents that are induced in the workpiece yields a magnetic repulsion between the workpiece and the forming coil, which cause the workpiece to deform.

A background on prior art apparatuses and methods for working of metal workpieces by the PMF process can be found in U.S. Pat. Nos. 3,654,787, 3,961,739, 4,170,887, 4,531,393, 4,807,731, 5,353,617 and 5,442,846, and in PCT Application Publication No. WO 97/22426.

When forming a shaped metal object from a planar metal plate, it is necessary at times to both shape a plate to acquire a desired three-dimensional pattern and to trim the edges so as to define the boundaries of the shaped metal object.

It is an object of the invention to provide PMF forming apparatus and method for forming a metal plate into a dish having a desired three-dimensional pattern and shape.

GENERAL DESCRIPTION OF THE INVENTION

The present invention provides, by a first of its aspects, an electromagnetic forming apparatus for forming an essentially planar metal plate into a dish having a three-dimensional pattern. A typical non limiting example of the invention is its application in the formation of a satellite dish from a planar plate.

In accordance with one embodiment, the apparatus comprises:

- a mold having a forming surface with a contour corresponding to said three-dimensional pattern, and having edges corresponding to boundaries of the dish, which edges are defined by side walls essentially perpendicular to the forming surface;
- a forming coil device opposite and proximal to said forming surface, and extending peripheral to said edges; the plate being
- accommodated between the forming coil and said forming surface; and
- an electric discharge circuitry for discharging a short and intense electric current pulse through the forming coil device to yield a pulsed magnetic forming (PMF) force for deforming said plate.

In accordance with one embodiment of the invention, the forming coil comprises a single coil member. In accordance with another embodiment of the invention, the forming coil device comprises an array of two or more coil members. The coil members in a forming coil comprising two or more coil members are typically concentric. An apparatus in accordance with this embodiment comprises:

- a mold having a forming surface with a contour corresponding to said three-dimensional pattern;
- a forming coil device opposite and proximal to said forming surface comprising two or more coil members; the plate being accommodated between the forming coil and said forming surface; and
- an electric discharge circuitry, comprising two or more discharge circuitries, one associated with each coil member, for discharging short and intense electric current pulses through the coil members to yield pulsed magnetic forming (PMF) forces for deforming said plate.

In the case of a forming coil comprising two or more coil members, the discharge circuitries may be timed to discharge the current pulse through all coil members simultaneously; or advantageously, the discharge is timed in accordance with a predetermined discharge sequence. For example, in the case of several concentric coil members, the discharge sequence may be such so that it propagates from the central coils to the peripheral ones; in the reverse direction, namely from the peripheral ones towards the central ones; or in any other desired discharge sequence designed to obtain a certain three-dimensional pattern.

In accordance with another embodiment of the invention, the forming coil comprises one or more coil members which are displaceable along an axis essentially normal to a plane defined by the metal plate. The apparatus in accordance with this embodiment comprises:

- a mold having a forming surface with a contour corresponding to said three-dimensional pattern;
- a forming coil device comprising one or more coil members, displaceable along an axis essentially normal to a plane defined by the metal plate;
- an electric discharge circuitry, comprising two or more discharge circuitries, one associated with each coil member, for discharging short and intense electric current pulses through the coil members to yield pulsed magnetic forming (PMF) forces for deforming said plate.

The forming coil in the apparatus according to this embodiment typically comprises two or more coil members separately displaceable along said axis. The deformation of the plate may comprise two or more steps. In the first step, the plate is partially deformed by a PMF force and then the coil members are displaced to an axial position corresponding to the displacement of the plate after the initial deformation. Then a PMF pulse is discharged again to further deform the plate, and this process may be repeated until the final shape has been attained.

In accordance with another embodiment of the invention, the forming coil device, which may comprise one or more coil members, has a size such that it covers only a portion of the plate to be deformed. An apparatus in accordance with this embodiment comprises:

a mold having a forming surface with a contour corresponding to said three-dimensional pattern;

a forming coil device opposite and proximal to said forming surface, and comprising one or more coil members having a size such that it covers only a portion of the plate to be deformed, the one or more coil members being displaceable in plane parallel to that of the plate;

an electric discharge circuitry for discharging a short and intense electric current pulse through each of the one or more coil members to yield a pulsed magnetic forming (PMF) force for deforming said plate.

In accordance with this embodiment, the forming coil member is first positioned at an initial position, a PMF pulse is generated to partially deform the opposite portion of the plate and then the forming coil is moved to another position opposite another portion of the plate whuch is then deformed by another PMF pulse. These steps are repeated untill the entire plate has been deformed to assume said there-dimensional pattern.

The mold, in accordance with one embodiment, comprises one or more depressions which correspond to said three-dimensional pattern. Typically, in accordance with this embodiment, the mold has a central concave portion, defining and serving as a template for a central concave portion of the dish. During deformation in which portions of the plate rapidly move into the depression, gases, e.g. air, remaining in the mold can resist the movement and thus prevent the obtaining of the desired three-dimensional shape. Accordingly, by one embodiment, gas-release ducts are provided to allow egression of gasses from the depression during this phase.. These may be connected to a vacuum source for removal of the gasses from the depression.

In accordance with another embodiment, the forming surface comprises bulges which define said three-dimensional pattern. In accordance with another embodiment of the invention, the forming surface comprises at least one depression and at least one bulge, which together define said three-dimensional pattern.

In accordance with another aspect the invention provides a method for electromagentic forming of a generally planar metal plate into a dish with a three-dimensional pattern. In accordance with one embodiment, the method comprises:

(a) providing a mold having a forming surface with a contour corresponding to said three-dimensional pattern, and having edges corresponding to boundaries of the dish, which edges are defined by side walls essentially perpendicular to the forming surface;

(b) placing the metal plate over the forming surface of the mold;

(c) providing a forming device coil connected to an electric discharge circuitry, and placing it over said metal plate, the forming coil extending beyond the edges of said forming surface; and (d) discharging a short pulse of an intense electric current through said coil to shear the plate along said edges and forcing other portions of said plate to assume a shape defined by said mold, thus obtaining said dish.

In accordance with another embodiment the method comprises:

(a) providing a mold having a forming surface with a contour corresponding to said three-dimensional pattern;

(b) placing the metal plate over the forming surface of the mold;

(c) providing a forming coil device, comprising two or more forming coil members each of which being connected to an electric circuitry, and placing the forming coil device over said metal plate;

(d) discharging a short pulse of an intense electric current through said two or more coil members to deform said metal plate;

(e) displacing said coil members along said axis to a position corresponding to the shape of the plate after the deformation and repeating step (d);

(f) repeating step (e) until attainment of said three-dimensional pattern.

In accordance with a further embodiment of the invention, the method comprises:

(a) providing a mold having a forming surface with a contour corresponding to said three-dimensional pattern;

(b) placing the metal plate over the forming surface of the mold;

(c) providing a forming coil device which comprises one or more coil members having a size such that it covers only a portion of the plate to be deformed, the one or more coil members being displaceable in a plane parallel to that of the plate, and placing the forming coil device over said metal plate;

(d) discharging a short pulse of an intense electric current through said coil to deform portions of the plate opposite said forming coil device;

(e) laterally displacing said forming coil device and repeating step (d);

(f) repeating step (e) until said three-dimensional pattern has been attained.

The invention will now be illustrated by describing some non-limiting specific embodiments depicted in the annexed drawings:

BRIEF DESCRIPTION OF THE DRAWINGS

FIGS. 8A–8C show the apparatus in different steps of the deformation process.

FIGS. 9A–9C show the apparatus in different steps of the dish-forming process.

FIGS. 12A–12C show the apparatus in three consecutive steps of the dish-forming process.

DETAILED DESCRIPTION OF SPECIFIC EMBODIMENTS

Figure 1:
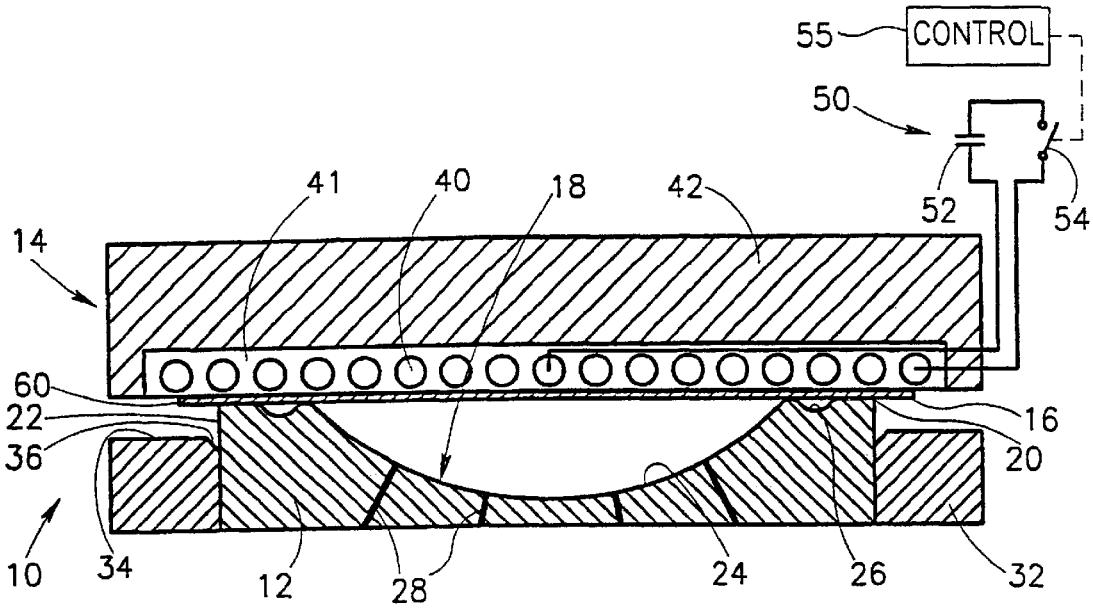
FIG. 1 is a schematical cross-section through a forming apparatus in accordance with an embodiment of the invention, prior to forming the metal plate.

Reference is first being made to FIG. 1 showing an apparatus generally designated 10, comprising a mold 12, a forming coil assembly 14 holding between them a metal plate 16.

Mold 12 has a forming surface 18 of a generally circular shape with edges 20, defined by upright side walls 22 with a central domed-shaped depression 24 and an annular groove 26. As will be appreciated, the specific shape of the mold which defines the shape of the dish to be formed in the apparatus is an example only and it may assume also a variety of other shapes. By way of illustration, the mold may have an overall rectangular shape, may have different kinds of depressions for forming dishes with different three-dimensional patterns, etc. Thus the specific illustrated embodiment does not derogate from the generality of the invention as defined herein.

Figure 3:
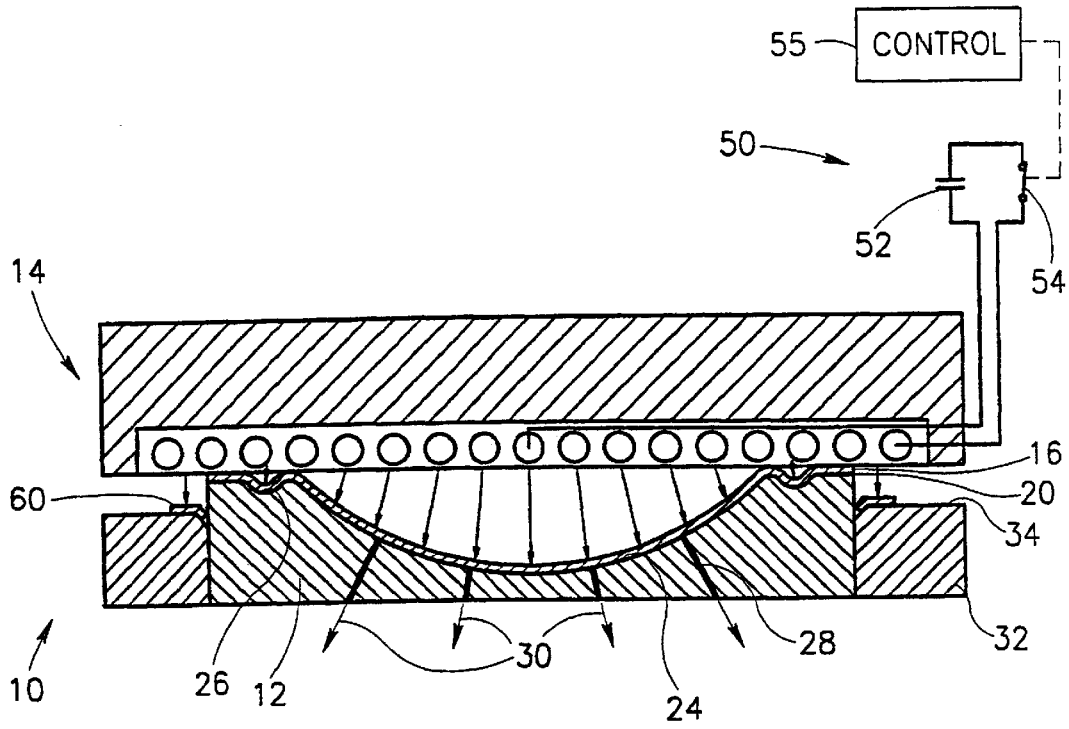
FIG. 3 is a schematical representation of the forming process.

Formed in mold 12 are a plurality of ducts 28 leading from depression 24 to a vacuum source (not shown) which draws gas from the depression (represented by arrows 30 in FIG. 3).

Mold 12 is surrounded by an annular member 32 which has an upper surface 34, below edge 20, and having a chamfered inner portion 36 for receiving and holding sheared material waste (see below).

Coil assembly 14 consists of a coil 40, embedded within space 41, formed at the bottom of a supporting block 42. Block 42 is preferably made of a non metallic substance. Coil 40 should be electrically insulated from surrounding metal objects, particularly metal plate 16, for which purpose space 41 may be filled by an electrically insulating material or alternatively coil 40 may be covered by an electrically insulating material.

Coil 40 is electrically connected to an electric discharge circuitry 50 comprising a capacitor battery 52 and a high current rapid discharge switch 54, both as known per se. An example of such a discharge switch is a controlled vacuum discharger such as that disclosed in Israel Patent Application No. 119826 and its counterpart PCT Application No. PCT/IL97/00383. Switch 54 is controlled by a control circuitry 55.

Metal plate 16 is generally planar and has boundaries such that it extends beyond edges 20 of mold 12.

Figure 4:
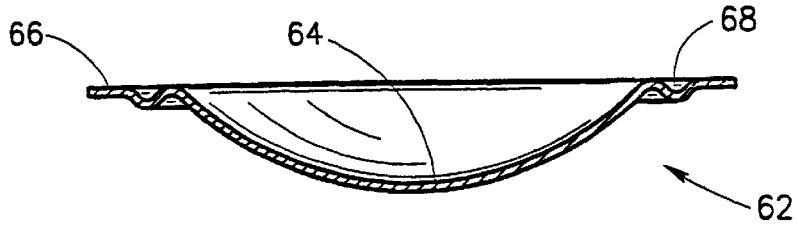
FIG. 4 is a cross-sectional view of a dish formed in the apparatus of FIG. 1 and by the illustrated process.

In operation, as illustrated in FIG. 3, switch 54 is closed, whereby electric current rapidly discharges through coil 40 yielding a pulsed magnetic force which forces a very rapid movement in portions of plate 16: portions overlaying depression 24 and annular groove 26 are deformed to assume a three-dimensional pattern defied thereby and peripheral edge portions 60 of plate 16 are sheared over peripheral edges 20 of the mold 12. Thus, a dish 62 as shown in FIG. 4, having a central concave depression 64 and a skirt 66 with an annular groove 68 is thereby formed. Such a dish is useful, for example, as an antenna, in particular such used in satellite communication. Annular member 32 can then be pushed upwards to allow disposal of sheared portion 60.

Figure 2:
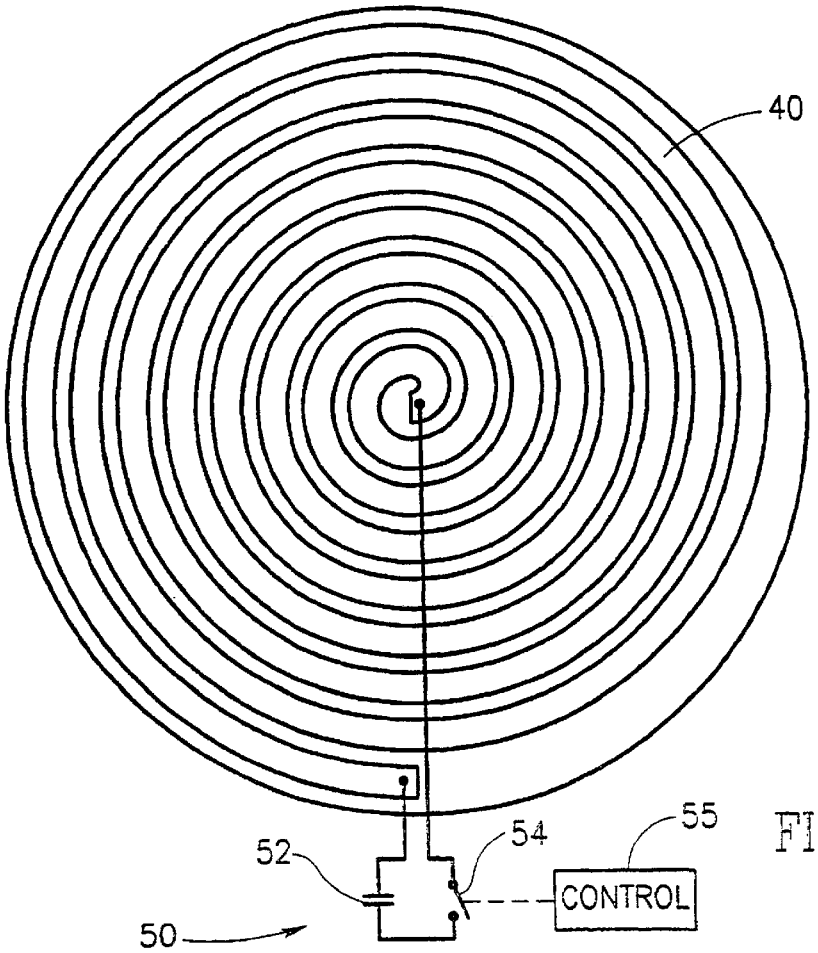
FIG. 2 is a top elevation of the coil of the apparatus of FIG. 1.
Figure 5A:
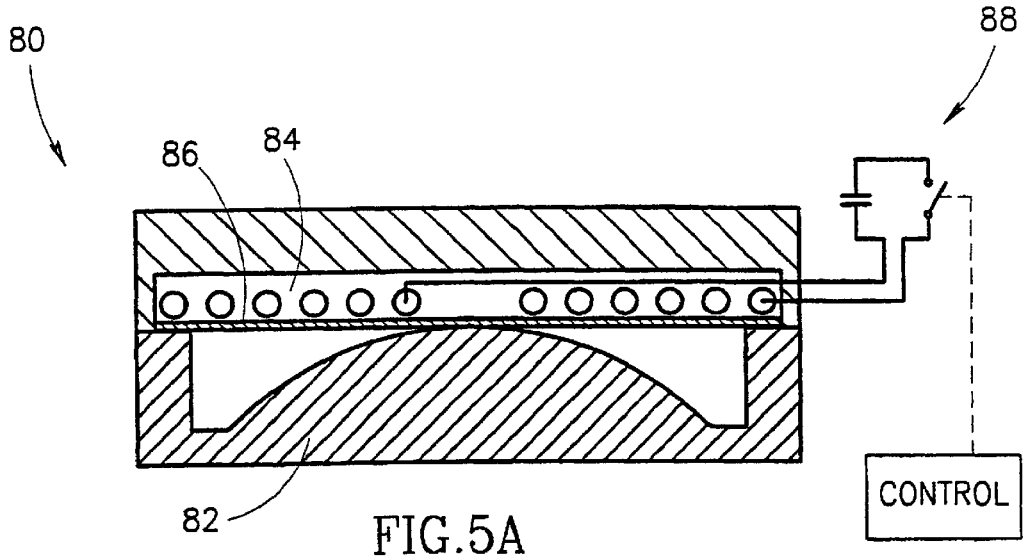
FIG. 5A is a schematical cross-section through a forming apparatus in accordance with another embodiment of the invention.
Figure 5B:
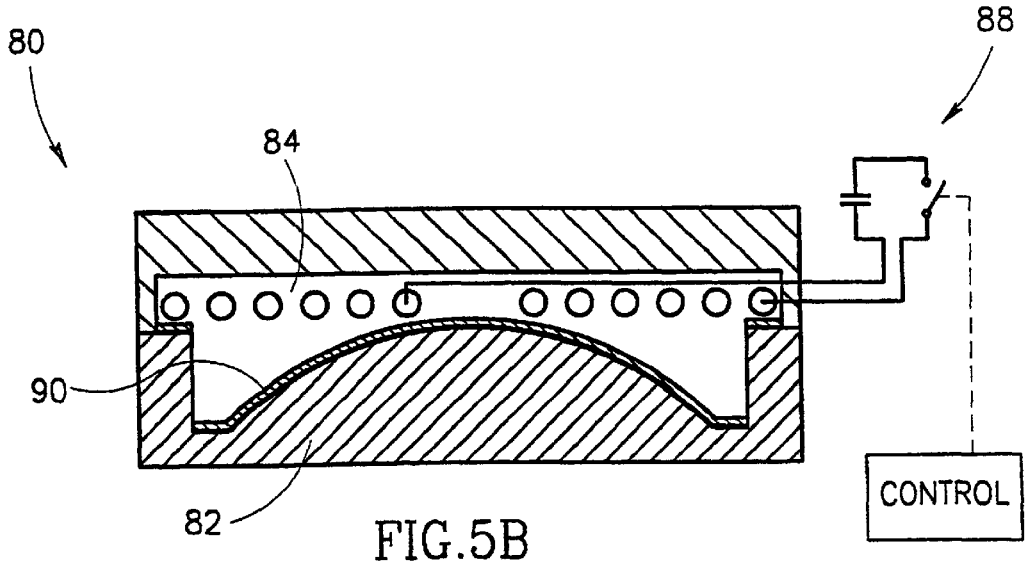
FIG. 5B shows the apparatus of FIG. 5A after formation of the dish.

Reference is now being made to FIGS. 5A and 5B showing an apparatus generally designated 80 in accordance with another embodiment of the invention. The apparatus comprises a mold 82 and a forming coil assembly 84 holding between them a metal plate 86, and comprises a discharge circuitry 88. A major difference between apparatus 80 of FIGS. 5A and 5B and apparatus 10 of FIG. 1 resides in that the mold, rather than being concave is convex. Otherwise, the operation of the apparatus is essentially the same as that described with reference to FIGS. 1 and 3 with FIG. 5B illustrating the apparatus after dish 90 has been formed from plate 86. As the process is essentially the same as that described with reference to FIGS. 1–3 the description will not be repeated again and the reader is referred to the description above.

Figure 6:
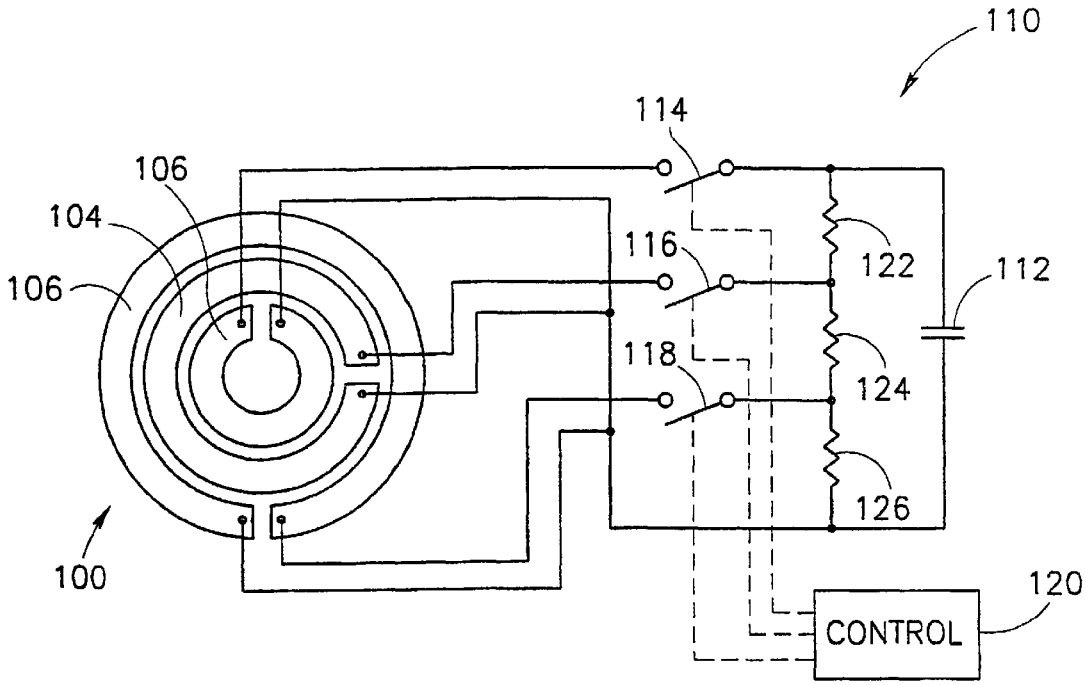
FIG. 6 is a top elevation of a forming coil device in accordance with another embodiment of the invention comprising an array of three forming coil members.

FIG. 6 shows an apparatus in accordance with another embodiment of the invention. In this embodiment, forming coil device 100 consists of an array of three forming coil members 102, 104, 106. Discharge circuitry 110 comprises a capacitor battery 112, three high current rapid discharge switches 114, 116 and 118 under control of control unit 120, each one associated with one of the coil members 102, 104 and 106, respectively, and comprises resistors 122, 124 and 126. Such a circuitry allows to independently discharge rapid current pulse through each of coil members 102, 104 and 106 in its desired sequence of operation. For example, in this case where the array consists of three concentric coil members, the discharge pattern may begin with current discharge through the central coil 102, continued with a discharge through coil 104 and then finally through coil member 106.

It should be appreciated, that an array of three coil members illustrated in FIG. 6 is but an example and the array may comprise any desired number of coil members, e.g. between two and ten.

As will also be appreciated, the electric discharge circuitry shown in FIG. 6 is but an example and a wide variety of different circuitries allowing to attain a sequential discharge through different coil members may be envisaged.

Figure 7:
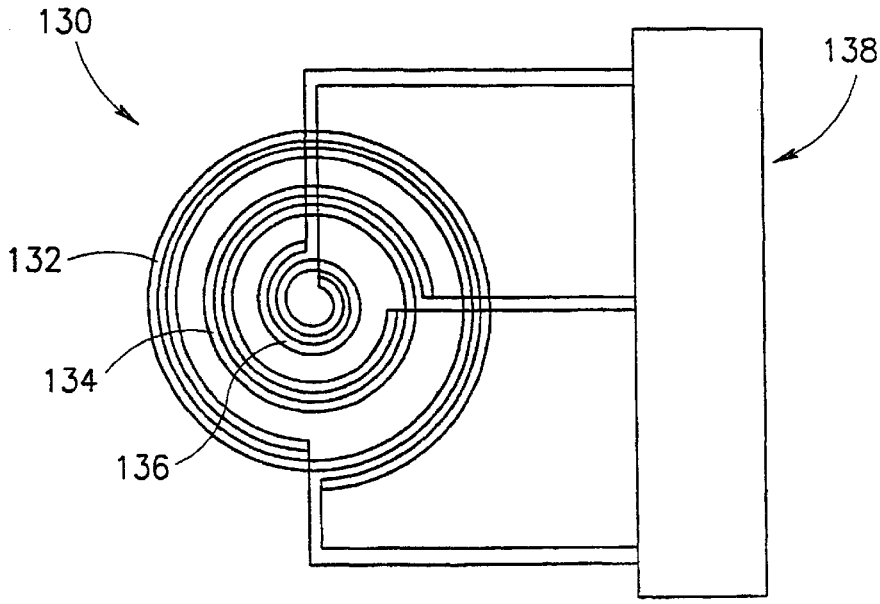
FIG. 7 is a top elevation of a forming coil device in accordance with another embodiment of the invention, comprising three coil members each consisting of several coil winds.

In FIG. 7, a forming coil device 130 in accordance with another embodiment of the invention is schematically illustrated. The forming coil device 130 comprises three coil members 132, 134 and 136, each consisting of a plurality of coil winds. In this example each coil member has two coil winds, although as will be appreciated this is an example only and the number of winds in each coil member may be any desired number, typically between 2 and 20. The coil of each coil member is connected to a discharge/control circuitry 138.

Figure 8A:
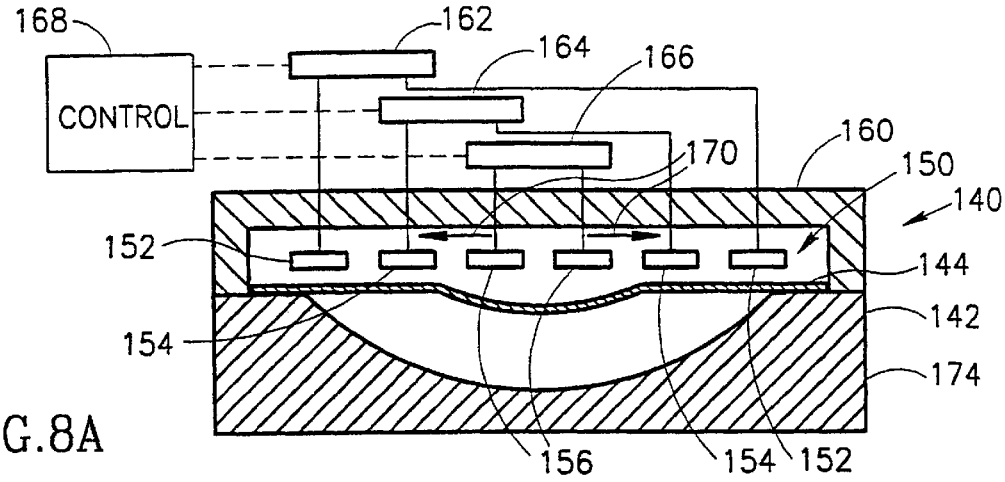
FIGS. 8A–8C are a schematical cross-section through a forming coil device in accordance with another embodiment of the invention a plurality (three in this specific embodiment) of coil members, each with a different, associated discharge circuitry.
Figure 8B:
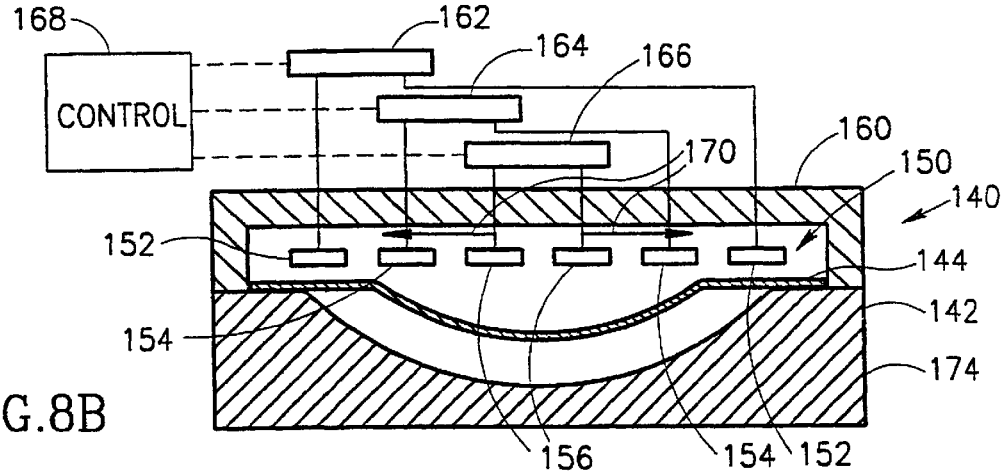
Figure 8C:
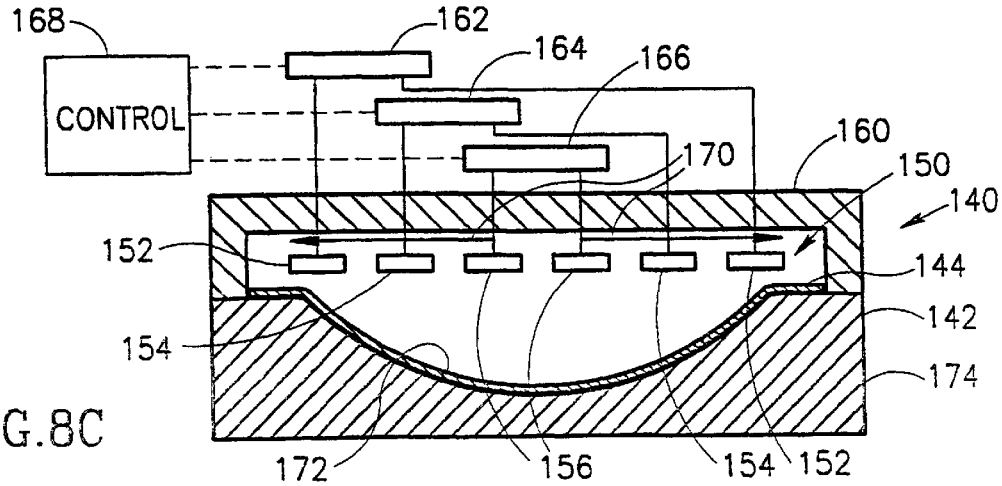

An apparatus in accordance with another embodiment of the invention is illustrated in FIGS. 8A–8C. The apparatus is essentially similar in design to that illustrated in FIG. 1, with the major difference being in that the forming coil device 150, comprises a plurality of coil members (three—152, 154, 156, are illustrated, although it will be appreciated that the forming coil device may comprise any other number of independent coil members). The forming coil device 150 is supported by supporting block 160. Each of members 152, 154, 156 is connected to a corresponding discharge circuitry 162, 164 and 166, all being under control of control unit 168.

In this specific embodiment discharge circuitries 162, 164 and 166 are timed to discharge rapid and intense electric current pulse consecutively, starting from the central member 156 (FIG. 8A) and progressing laterally (represented by arrows 170), to discharge through coil member 154 (FIG. 8B) and then finally in coil member 152 (FIG. 8C) yielding a dish 172 with a three-dimensional pattern defined by mold 174.

Figure 9A:
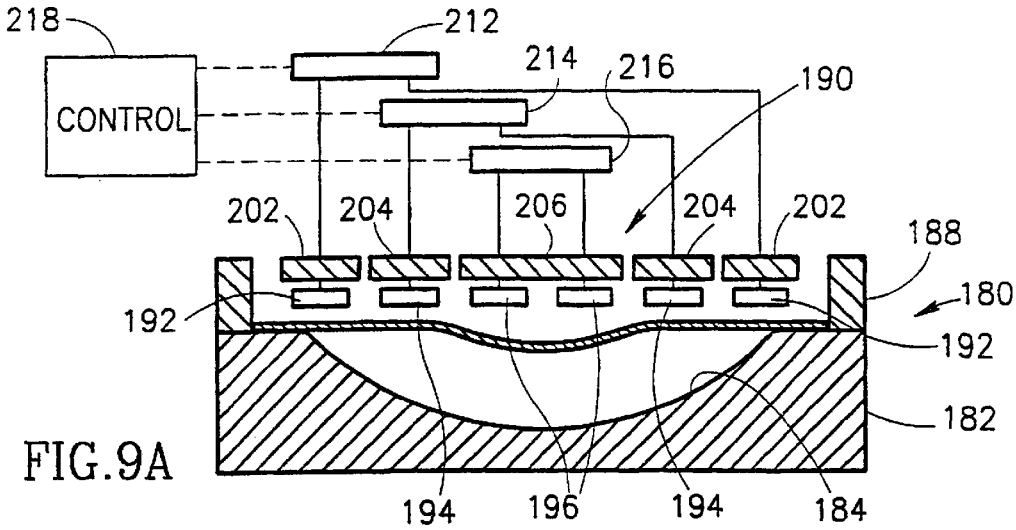
FIGS. 9A–9C are schematical cross-sections through a forming apparatus in accordance with another embodiment of the invention with a plurality (three in this specific embodiment) of coil members, each separately displaceable in an axis normal to the plane defined by the plate.
Figure 9B:
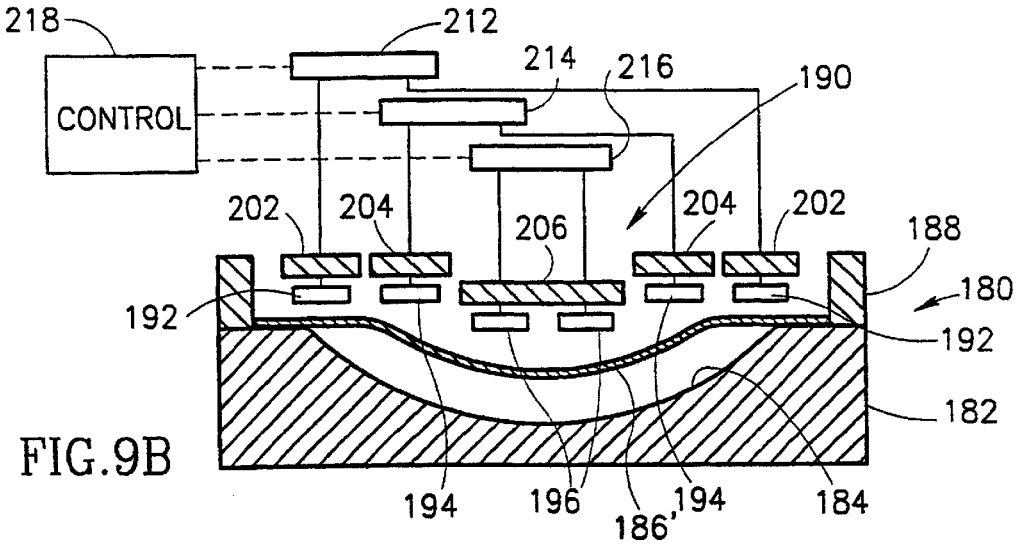
Figure 9C:
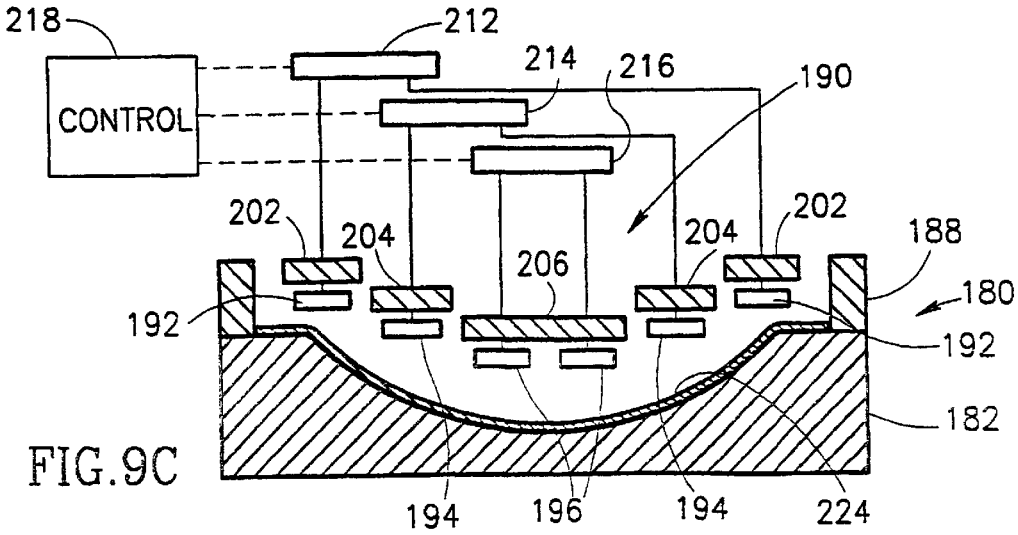

An apparatus 180 in accordance with another embodiment of the invention is illustrated in FIGS. 9A–9C. The apparatus comprises a mold 182 with a concavity 184 defining a three-dimensional pattern of the dish to be formed from plate 186 which is accommodated within peripheral supporting walls 188.

Forming coil device 190, comprises a plurality of coil members, three in this specific embodiment—192, 194 and 196. Each coil member is displaceable in an axis normal to the plane defined by the plate and is supported by an associated displaceable support block 202, 204 and 206, respectively. Similarly as in the embodiment of FIGS. 8A–8C, each coil member is connected to a respective discharge circuitry 212, 214 and 216 controlled by control unit 218.

FIG. 9A illustrates the apparatus after an initial deformation accomplished by a PMF current discharge through coil member 196 and then sequentially through coil members 194 and 196, whereby a partial deformed plate 186', as can be seen in FIG. 9B. Then the coil members are axially displaced towards the deformed plate 186', so that each will be in a position more proximal to the plate and then a PMF pulse is again sequentially discharged through different coil members, similarly as before. By such 5 repeated sequence, the plate becomes fully deformed yielding dish 224 (FIG. 9C).

Figure 10A:
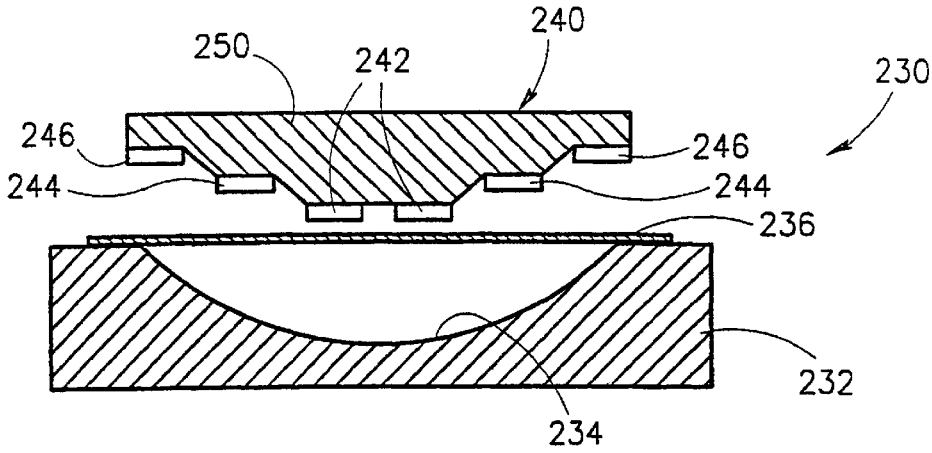
FIGS. 10A and 10B show an apparatus in accordance with another embodiment of the invention in an initial stage (FIG. 10A) and in a final forming stage (FIG. 10B) of the dish-forming process.
Figure 10B:
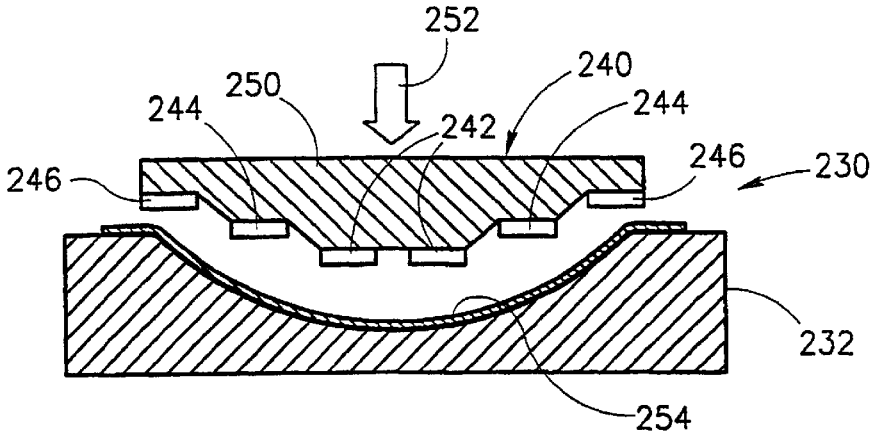

FIGS. 10A and 10B show an apparatus generally designated 230 in accordance with another embodiment of the invention. This apparatus comprises a mold 232 with a concavity 234 and supporting plate 236. Forming coil device generally designated 240 comprises a plurality of coil members, three—242, 244 and 246, being shown in this specific embodiment, supported by a supporting block 250. The different members are spatially arranged such that they generally follow a contour corresponding to that of concavity 234. The deformation in this case is achieved by a sequential discharge of a PMF current through one or more of coil members and then displacing the entire block with the coil members in an axial direction represented by arrow 252 until a final deforming plate 236 to yield dish 254.

Figure 11:
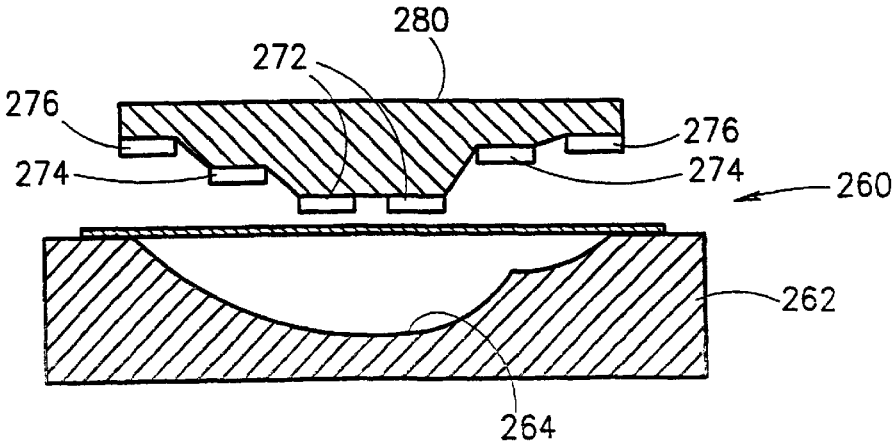
FIG. 11 shows another embodiment of an apparatus of the invention wherein the mold has a non-symmetrical shape.

FIG. 11 illustrates an apparatus 260 which is essentially similar to the embodiment of FIG. 10A but here, rather than a symmetrical concavity 254, concavity 264 in mold 262 is non symmetrical. Accordingly, the spatial position of each of coil members 272, 274 and 276, supported by support block 280, have a general spatial position corresponding to the contour of concavity 264.

In FIGS. 10A, 10B and 11, the electric circuitries have been omitted for the sake of simplicity of description.

Figure 12A:
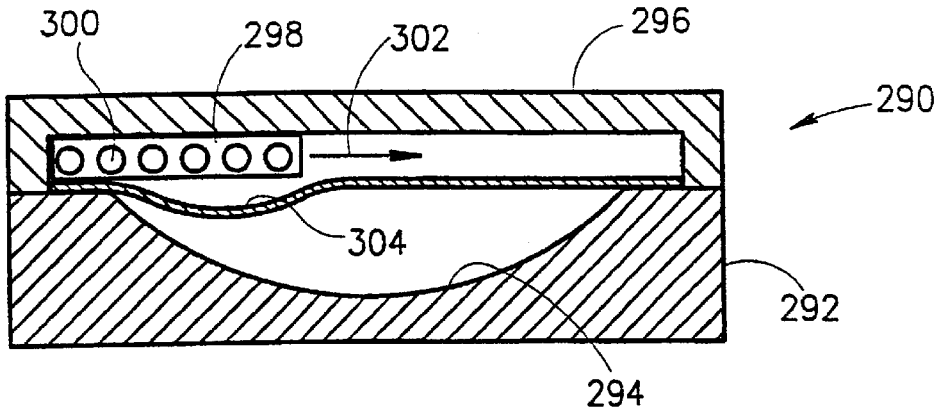
FIGS. 12A–12C are schematical cross-sections through an apparatus in accordance with the invention with a coil member displaceable in a plane parallel to that defined by the plate.
Figure 12B:
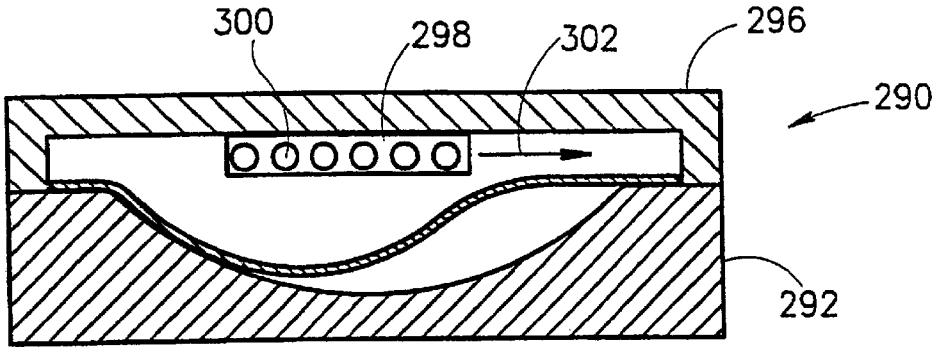
Figure 12C:
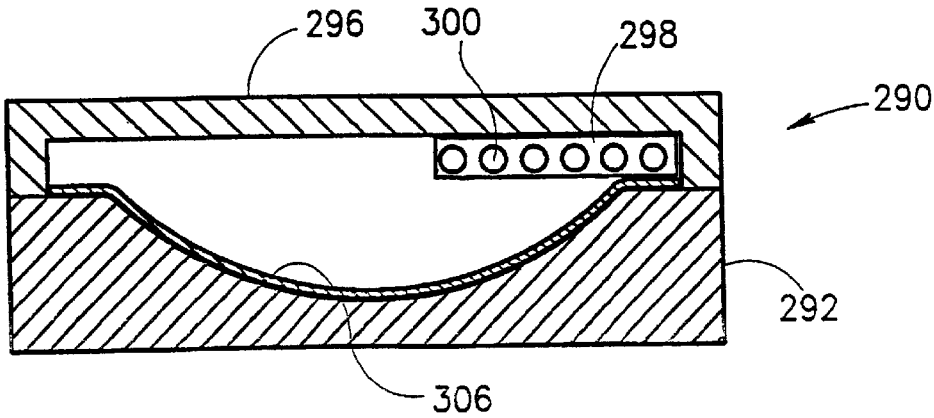

Reference is now being made to FIGS. 12A–12C illustrating an apparatus 290 in accordance with another embodiment of the invention. The apparatus comprises a mold 292 with a concavity 294 and a supporting block 296 accommodating a forming coil device 298. The forming coil device accommodates a coil 300, is horizontally displaceable as represented by arrows 302. It should be noted that in principle forming coil device 298 may also be displaceable along an axis normal to the plane of the sheet.

The forming coil device is placed over one portion of plate 304, a PMF current is passed through the coil (a discharge circuitry not shown) and then the coil device is moved to another position, the PMF current is discharged again, displaced again and so forth until the entire plate is deformed to yield dish 306.

What is claimed is:

1. An electromagnetic forming apparatus for forming an essentially planar metal plate into a dish having a three-dimensional pattern, the apparatus comprising:

a mold having a forming surface with a contour corresponding to said three-dimensional pattern, and having edges corresponding to boundaries of the dish, which edges are defined by side walls essentially perpendicular to the forming surface;

a forming coil device opposite and proximal to said forming device, and extending peripheral to said edges, the plate being accommodated between said forming coil and said forming surface; and an electric discharge circuitry for discharging a short and intense electric current pulse through the forming coil device to yield a pulsed magnetic forming (PMF) force for deforming said plate, wherein the forming surface of the mold has a central concave portion defining and serving as a template for a central concave portion of the dish, the central concave portion being provided with ducts for release of gasses, and wherein said ducts are connected to a vacuum source for the removal of gasses from the depression.

2. An electromagnetic forming apparatus for forming an essentially planar metal plate into a dish having a three-dimensional pattern, the apparatus comprising:

a mold having a forming surface with a contour corresponding to said three-dimensional pattern, and having edges corresponding to boundaries of the dish, which edges are defined by side walls essentially perpendicular to the forming surface;

a forming coil device opposite and proximal to said forming device, and extending peripheral to said edges, the plate being accommodated between said forming coil and said forming surface; and an electric discharge circuitry for discharging a short and intense electric current pulse through the forming coil device to yield a pulsed magnetic forming (PMF) force for deforming said plate, wherein said mold is surrounded by an annular member substantially lower than said forming surface and wherein a pulsed magnetic force is applied on a portion of the plate extending beyond the edges of said forming surface; said annular member having an upper surface and a chamfered inner portion for receiving sheared portions of said plate.

3. A method for electromagnetic forming of a generally planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming surface;

(b) placing the metal plate over the forming surface of the mold with boundaries of the plate extending beyond said edges;

(c) providing a forming device coil connected to an electric discharge circuitry, and placing it over said metal plate, the forming coil extending beyond the edges of said forming surface and beyond the boundaries of said plate; and (d) discharging a short pulse of an intense electric current through said coil to shear the plate along said edges, and forcing other portions of said plate to assume a shape defined by said mold, thus obtaining said dish, wherein the forming surface of the mold has a central concave portion defining and serving as a template for a central concave portion of the dish, the central concave portion being provided with ducts for release of gasses, and wherein said ducts are connected to a vacuum source for the removal of gasses from the depression.

4. A method for electromagnetic forming of a generally planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming surface;

(b) placing the metal plate over the forming surface of the mold with boundaries of the plate extending beyond said edges;

(c) providing a forming device coil connected to an electric discharge circuitry, and placing it over said metal plate, the forming coil extending beyond the edges of said forming surface and beyond the boundaries of said plate; and (d) discharging a short pulse of an intense electric current through said coil to shear the plate along said edges and forcing other portions of said plate to assume a shape defined by said mold, thus obtaining said dish, wherein said mold is surrounded by an annular member substantially lower than said forming surface and wherein a pulsed magnetic force is applied on a portion of the plate extending beyond the edges of said forming surface; said annular member having an upper surface and a chamfered inner portion for receiving sheared portions of said plate.

* * * * *